US005321381A

United States Patent [19]

Essig

[11] Patent Number: 5,321,381

[45] Date of Patent: Jun. 14, 1994

[54] BASE FOR AN ELECTROMECHANICAL FUNCTIONAL UNIT

[75] Inventor: Willi Essig, Boeblingen, Fed. Rep. of Germany

[73] Assignee: E.G.O. Elektro-Gerate Blanc u. Fischer, Fed. Rep. of Germany

[21] Appl. No.: 981,655

[22] Filed: Nov. 25, 1992

[30] Foreign Application Priority Data

Nov. 26, 1991 [DE] Fed. Rep. of Germany ..... 4138815

[51] Int. Cl.[5] ..... H01H 37/04; H01H 37/46

[52] U.S. Cl. ..... 337/398; 337/383

[58] Field of Search ..... 337/383, 382, 384, 388, 337/389, 390, 391, 398, 399; 248/205.3

[56] References Cited

U.S. PATENT DOCUMENTS 4,317,554 3/1982 Winger ..... 248/205.3
4,999,887 3/1991 Kraus ..... 248/205.3

FOREIGN PATENT DOCUMENTS 0141923 5/1988 European Pat. Off. .
1837987 9/1961 Fed. Rep. of Germany .
1187298 10/1965 Fed. Rep. of Germany .
1973470 11/1967 Fed. Rep. of Germany .
2241620 3/1974 Fed. Rep. of Germany .
1777166 4/1977 Fed. Rep. of Germany .
3540414 5/1987 Fed. Rep. of Germany .
3612111 10/1987 Fed. Rep. of Germany .
3705260 9/1988 Fed. Rep. of Germany .
3913288 10/1990 Fed. Rep. of Germany .
3913289 10/1990 Fed. Rep. of Germany .
4029351 3/1992 Fed. Rep. of Germany .
864362 9/1981 U.S.S.R. .
1283917 9/1969 United Kingdom .

*Primary Examiner*—Harold Broome
*Attorney, Agent, or Firm*—Quarles & Brady

[57] ABSTRACT

A base (1) provided with movable and mechanically loaded operational parts has a planar, plate-like base body (3), to which are fixed support bodies (5 to 9) located on an assembly side (4) with plate-like connecting parts (17, 18) exclusively by means of adhesive connections (10), such as melted joints, so as to be closely engaging and correctly operationally positioned. This construction is suitable for numerous switching, control and regulating devices and permits simple manufacture, low weight, high strength, good accessibility and high operational reliability.

31 Claims, 2 Drawing Sheets

BASE FOR AN ELECTROMECHANICAL FUNCTIONAL UNIT

DESCRIPTION

Figure 1:
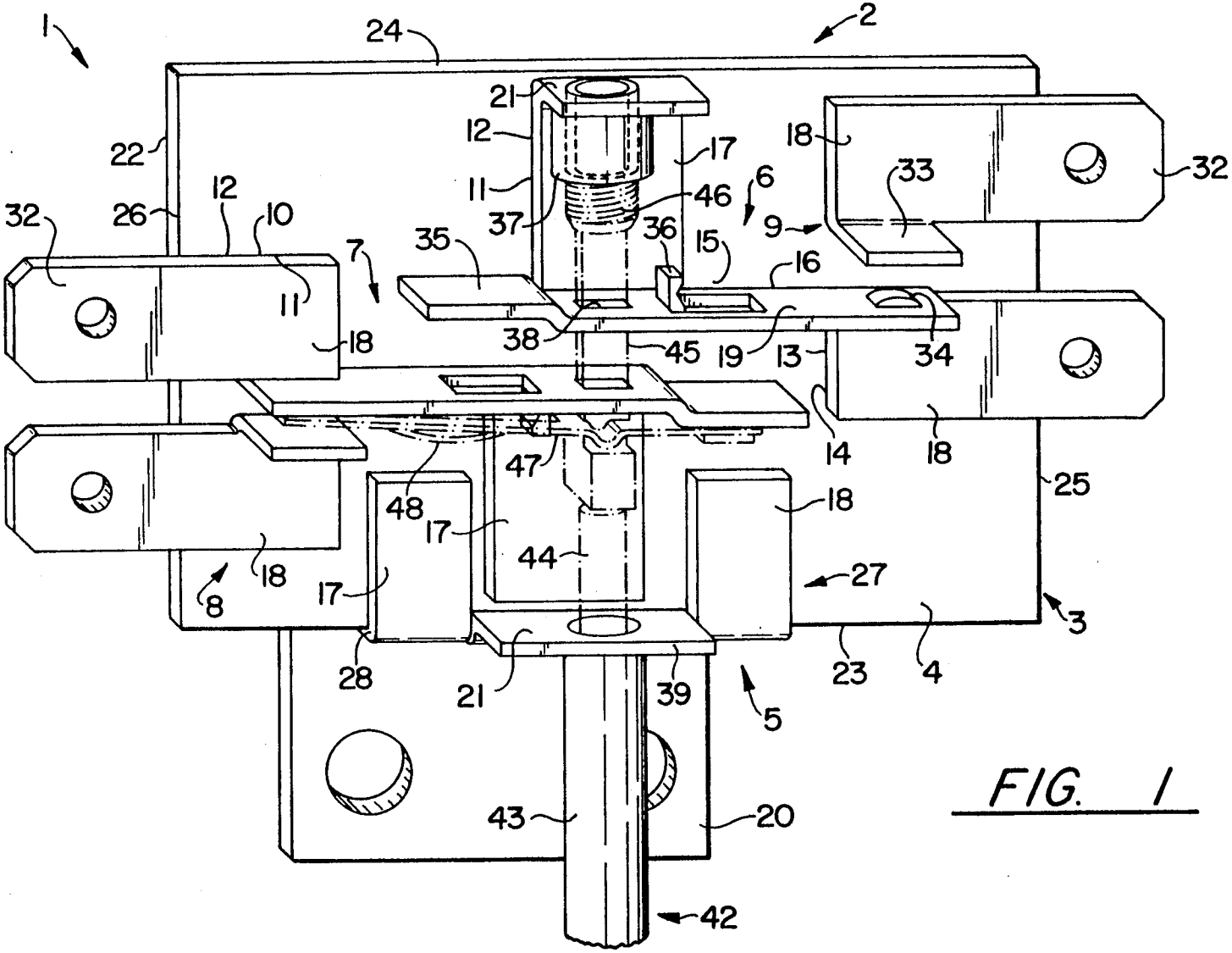

The invention relates to the e.g. supporting basic body unit for mechanically, thermally and loaded functional units, such as are e.g. formed by switching devices for electrical heating devices. Such switching devices can be thermal cutouts, signal switches, manually adjustable, timing power control devices or sensor-controlled temperature regulators, circuit-breakers and cam switches for several power stages and the like.

Appropriately the base has one or more optionally positionally rigidly interconnected base bodies, on which can be fixed electrically insulated support bodies for electrical switching elements, thermally or manually controlled actuating elements, connecting members for appliance lines, etc. At least one support body is advantageously connected in substantially clearance-free, positionally rigid manner to one or more base bodies, in such a way that with respect thereto it is fixed by one or more bolts and/or in that it directly engages in e.g. slot-like receptacles of the base body. The receptacles or passage openings for the bolts require a relatively complicated construction of the base body on the assembly side, which can in particular lead to difficulties if the base body is made from a ceramic material, such as steatite, because it is not then possible to maintain especially close manufacturing tolerances. The arrangement of the support body positioned in recessed manner in the assembly side of the base body can made assembly, as well as adjustment or ventilation more difficult, because the support bodies and the associated functional parts are scarcely accessible following installation. The fastenings of the support body can also become loose as a result of the mechanical load changes occurring during the long period of use, so that satisfactory operation can be impaired.

The problem of the invention is to provide a base of the aforementioned type, which avoids the disadvantages of known constructions of the described type and in which, whilst having a simple construction, it is possible to ensure a very reliable, durable fixing of at least one support body and/or which is positionally accurate within the narrowest tolerances.

For solving the problem at least one support body or the like, particularly a support body which, due to the operation of the operational unit or due to a movable operational unit, is exposed to varying or alternating mechanical stresses, is fixed by means of an adhesive connection or joint, which is appropriately heat resistant and thermally stable up to at least 200° C. or over 300° or even 400° to 500°, so that the operational unit can also be used in appliances, where the base is exposed to high operating temperatures, such as in the case of a cooker or baking oven heating system. The adhesive joint can be very space-saving, because on the side of the associated connecting part remote from the adhesion side there is no need for projecting components, such as bolt heads, and also all portions of the particular support body connected to the connection part are completely free and are readily accessible from most sides.

Another advantage of this solution is that the base body is free from pockets, depressions, openings, etc. and therefore in principle the same base body can be used for completely different operational units in that the necessary support bodies are correspondingly positioned on the base. Thus, the base body can be constructed as a plate or panel, which on one or both sides is planar throughout and/or can have uninterrupted, through outer edges. Thus, the base body can be constructed as a portion or cutout from a larger plate, which requires no further shaping machining following the free cutting of its outer edges. Therefore the same plate material can be used for base bodies of the most varied sizes.

Instead of constructing the base body from several components, e.g. in sandwich-like manner, in that it is provided in the vicinity of the assembly surface and/or on the side remote therefrom with an electrically insulating coating, e.g. on a metallic basic or reinforcement body, over its entire thickness and/or its surface extension, the base body is appropriately constructed in one piece from such an insulating material. The latter is advantageously a sintered, baked, compressed or otherwise compacted or solidified material made thermally stable, which can be produced from a fibre-containing, particle-containing floury or similar starting material, optionally accompanied by the addition of a binder and which is provided with an adequate dimensional stability with respect to the thermal or mechanical loads which occur. The structural density of the base body in the surface region of the assembly surface is appropriately greater than in the following core region, which can have a certain porosity. The base body is also resistant to bending, bulging and tension under the operating conditions and loads. The base body can have a plate thickness of approximately 1 to 3 or 5 mm, which is approximately of the same order of magnitude as the material thickness of the support body or only slightly exceeds the same, so that the base has a very low weight. The support body simultaneously forms a very effective reinforcement through which at least one of the said resistances or strengths of the base body is further increased, so that it can be made thinner than when no such reinforcements are provided.

It is also conceivable to provide the assembly surfaces of the base body in oppositely transversely displaced planes, e.g. on both plate sides of the base body and/or to produce the connecting parts of the support body from different or differently thick materials, but a particularly simple construction is obtained if all the assembly or connecting surfaces optionally on a single plate side are located in a common plane or optionally in a through-out slightly curved plane or if essentially all the connecting parts or support bodies are made from the same starting material, e.g. a metal sheet and therefore have the same thickness. Consequently the support body is simply manufacturable as a stamped bent part from a metallic material.

In order to further increases the strength and to bring the receptacles of the support body for the operational parts in simple manner to external spacing with respect to the assembly side of the base body, at least one support body in cross-section is constructed as a profile with profile portions located in alternating directions. Particularly suitable for this purpose are angle and U-profiles, although it is possible to provide at least one circumferentially closed profile and in each case a through, planar profile portion forms the associated connecting surface over its entire surface extension. If in longitudinal spacing are provided connecting surfaces for the same support body and which are optionally only connected by means of an edge face or not at all, then the strength of the connection is further increased, even in the case of different thermal expansions with respect to the materials used.

The base body can form a plate-like shield of the electrically conducting operational part of the operational unit, so that none of the operational parts is accessible or free from the side remote from the assembly side, optionally except for connecting members for appliance lines. However, the base body could also be provided e.g. as a perforated plate with uniformly distributed openings, which would permit in at least all directions parallel to the assembly surface an interlocking engagement of a support body, particularly in the vicinity of the connecting surface. However, such an engagement is also exclusively possible in the vicinity of at least one outer edge of the base body, if the support body has a corresponding engagement profile, which is appropriately constructed in one piece with the support body, namely its connecting part and/or its support part and is connected to said support part.

For example, a profile leg of a support body projecting transversely to the assembly surface can engage in stop-like manner on an edge face of the base body and consequently facilitate orientation or alignment. A profile leg can also engage on the base body side remote from the assembly side, so that the support body is positively secured with respect to the base body against movements in both opposite directions transversely to the assembly surface. If at least one of these legs engages in a depression of the base body, e.g. a depression in the edge face, there is also a positive securing in one or both opposite directions parallel to said edge face, so that the support body has only a single movement or plugging degree of freedom with respect to the base body. As a result of the said legs the base body can also be given a corresponding edge protection, e.g. against impact or breaking loads in the edge region.

It is also possible to fix in the described manner non-electrically conducting parts to the base body, e.g. a flange plate projecting over the outside of the operational unit for fixing the entire operational unit to an appliance and/or a temperature sensor or the outer tube of a rod-like expansion sensor, which with the associated support body forms a preassembled standard component and which is e.g. fixed by welding. If operational parts are to be positioned on a substantially completely metallically bare support body exposed on the assembly side of the base body and which is to be accessible from the outside e.g. in the manner of an adjustment member, then at least one such operational part can be mounted or fixed on the support body, whilst interposing an insulator.

According to a further development of the invention fastening or tacking means are provided in order to fix one and up to all the support bodies prior to producing the final adhesive joint, in a provisional manner to the assembly side of the support body, e.g. using a self-adhesive adhesive coating. This adhesive coating can be formed by a connecting coating provided for the adhesive joint and/or by a separate coating, which e.g. is decomposed or dissolved during the production of the final adhesive joint. The adhesive joint is appropriately of the type which is obtained by heating and/or pressure and subsequent cooling, the temperature of the heating, e.g. the melting point for producing the adhesive action, can be above the maximum thermal stress of the operational unit in the vicinity of said temperatures, in order to ensure a completely reliable thermal stability for the adhesive joint.

Instead of, without using an additional connecting coating, producing the connection or joint in that the assembly surface of the base body is briefly melted by heating during the production of the joint, it is possible to use as a separate connecting coating a solder coating, a thin ceramic or glass coating, etc., which is appropriately applied by lining or pressing on to the assembly surface and only then does the connection to the connection face of the particular support body take place. All the connecting coatings can be simultaneously applied or in a single operation and all the support bodies can be simultaneously and finally adhered to the base body in a single operation, e.g. by stoving on passing through a corresponding furnace chamber.

The connecting coating is appropriately uninterrupted within the outer edges of the particular connecting surface and can also project slightly over said outer edges, where it can form fillet welds with the edge faces of the particular connecting part. The thickness of the connecting coating is appropriately in the μm range, so that the connecting face of the support body can partly engage directly on the assembly face of the base body or only has a gap spacing therefrom, which is of the above order of magnitude. The connecting coating material is such that it can penetrate both the pores of the assembly surface and those of the connecting face and can consequently be anchored in substantially non-detachable manner. The assembly surface is consequently also an accurate reference surface for orienting the support body or operational parts transversely to the plane of the assembly side with an accuracy in the range of tenths of a mm or below.

This is in particular possible because each support body has a substantially one-piece contruction over its entire extension and by its connecting face or edge faces forms interconnected, prefabricated and flexurally rigid stop faces. The base body can also be substantially flexurally rigid in the sense that even the slightest bending deflections do not lead to an elastic or permanent deformation and instead cause a breakage. After reinforcing the support bodies the breaking strength of the base is still well above the loads to be expected during assembly, mounting and in operation, even under the least favourable circumstances.

The surface on the assembly side of the base covered by the assembly faces or joining faces can be approximately half the associated overall surface or more, so that there is a relatively dense coverage or occupancy of the assembly side with more or less uniformly distributed connection parts and the base body consequently in the vicinity of each connecting part has the structure and effect of a multilayer or laminated sandwich plate. One up to all the connecting parts project by their plate or material thickness over the outermost front side of the base body formed by the assembly side. The densest occupancy of the assembly side with the connection parts can e.g. also be achieved in that between two roughly parallel connecting parts or in the angle or corner zone between two transversely or right-angled positioned connecting parts of a support body engages at least one connecting part of a further support body and that most connecting parts extend approximately to the associated outer edges of the base plate.

The overall size of the connecting surface or surfaces of the support body is appropriately of the same order of magnitude as the greatest surface extension of the associated support part, whose greatest extension parallel to the assembly surface is appropriately several times larger than at right angles thereto.

These and further features can be gathered from the claims, description and drawings and the individual features, either singly or in the form of subcombinations, can be realized in an embodiment of the invention and in other fields and represent advantageous, independently protectable constructions for which protection is hereby claimed. Embodiments of the invention are described in greater detail hereinafter relative to the drawings, wherein show:

FIG. 1 An inventive base in perspective view.

Figure 2:
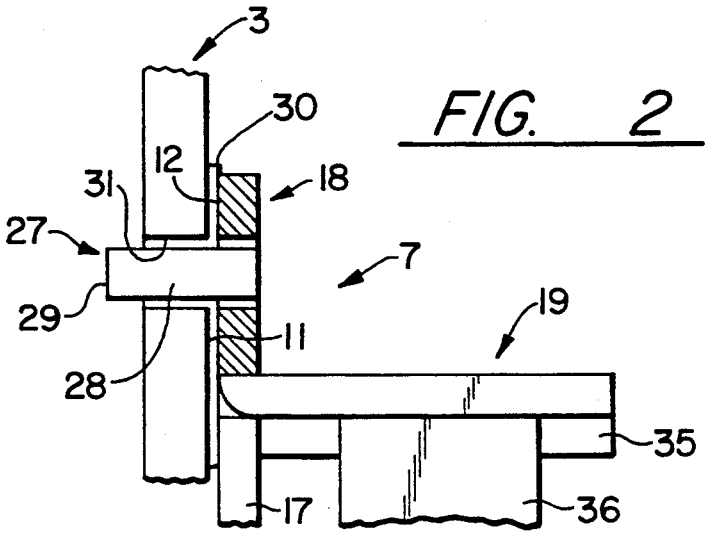

FIG. 2 A detail of FIG. 1 in cross-section and with slightly modified construction.

Figure 3:
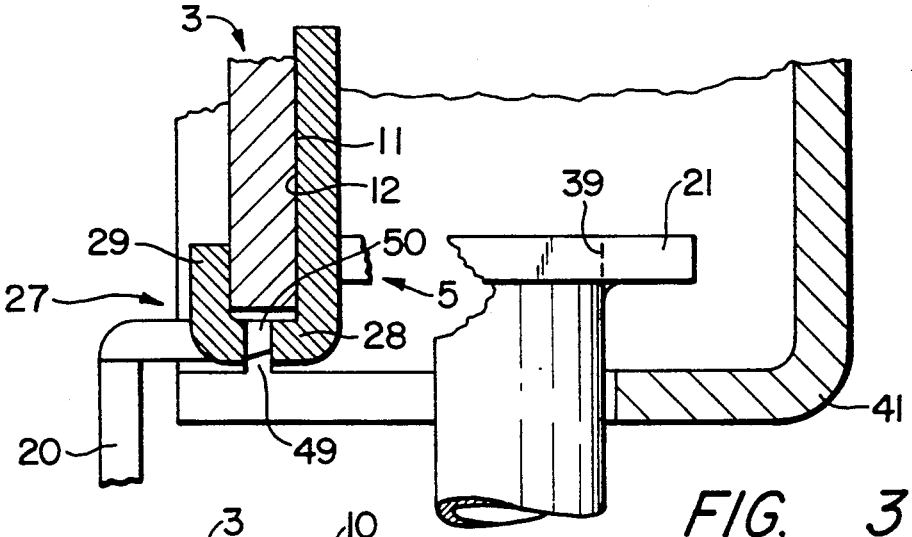

FIG. 3 Another detail of FIG. 1 in cross-section.

Figure 4:
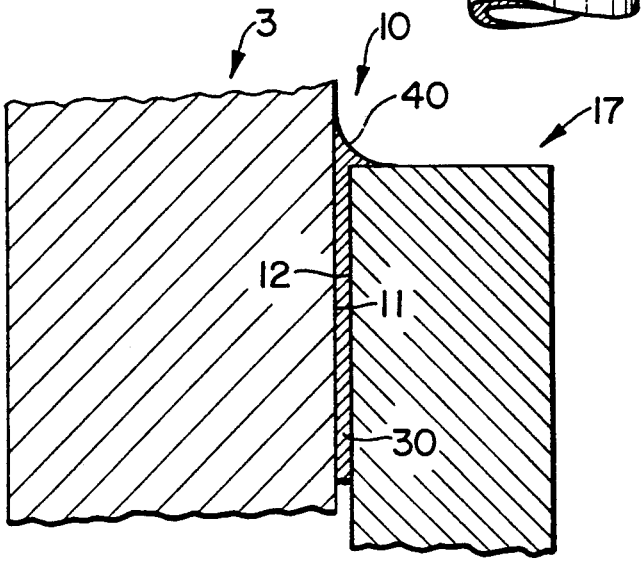

FIG. 4 A larger-scale cross-section through a junction.

In the represented case the base 1 serves as an overall basic body of a functional or operational unit 2 indicated by dot-dash additions, which has the basic body and movable and/or positionally rigid components mounted, guided, held, etc. thereon. The base is formed from one or more optionally equiplanar, juxtaposed, gap-spaced base bodies 3 and support bodies 5 to 9 located on its single assembly side 4 so as to form a preassembled subassembly. This subassembly is high temperature-resistant and to it can then be fitted or fixed less temperature-resistant components or subassemblies during subsequent operations.

The base body 3 is appropriately formed from a pourable or flowable starting material, such as a slop, which under mechanical pressure and/or the supply of exogenous heat, can be baked or dried in a mould to form a base body 3 and then forms a brittle shaped article or blank, which following removal from the mould and without any further working or machining directly forms the base body 3. The support bodies 5 to 9 are in each case constructed in one piece as metal mouldings having a substantially constant material thickness throughout and are in each case fixed by means of one, two or more adhesive connections or joints 10 in whole-surface manner directly to the assembly side 4. One and up to all the adhesive joints 10 have a substantially elongated, rectangular surface extension and are in each case positioned in the vicinity of an approximately equally large assembly surface 11 or 13 or 15 of the base body 3 and an approximately equally large connecting surface 12 or 14 or 16 of the associated support body 5 to 9.

All the assembly or joining surfaces assume a relative large surface proportion of the field of the assembly side 4 occupied by them and this can be defined by the smallest circle to be placed round said field or the smallest rectangle to be placed round said field, whose outer edges are either parallel to the outer edges of the base body 3 or the assembly or connecting surfaces or are inclined thereto. Compared with this field the surface proportion is large than 10 or 20% and is appropriately approximately 30% or more. In the circular field and virtually in each radial spacing from the circle centre there is an adhesive connection and the radial gaps free from adhesive connections are smaller than the radial extensions of one or all the adhesive connections or are only approximately one to five times the thickness of the base body 3. In the rectangular field the adhesive connections 10 are located approximately in each line, which is parallel to one or all the outer edges of said field and any gaps can also have said order of magnitude. Thus, the base body 3 is effectively protected against breakage, so that it can be constructed as a very thin, uniformly planar plate with parallel, smooth-faced plate sides and edge faces at right angles thereto.

The reinforcement is obtained in that most or all of the connecting faces are formed by plate faces of plate-like connecting parts 17, 18, which are fixed in whole-surface manner in closely connected form to the assembly side 4 by the adhesive connections 10 and form rib-like web or profile legs projecting freely at right angles from the assembly side 4 and with a simultaneously provided as support parts 19, 21 for the operational parts and form the only stiffening ribs projecting from the assembly side 4. The support parts 19, 21 have roughly the same thickness as the connecting parts 17, 18 connected in one piece therewith, but in a view of the assembly side can project parallel to the plate plane thereof over the associated adhesive connection 10 by an amount which is greater than half or a multiple of the parallel extension and/or the extension measured at right angles thereto with respect to said adhesive connection 10. The support part 21 can also be substantially completely located within the associated adhesive joint 10 or project over it by at the most its material thickness.

As a function of the operationally caused loading of the support body or the support part 19, the latter can also be fixed with two connecting parts 17, 18, which in the longitudinal direction of the support part 19 or parallel to an outer edge of the base body 3 are spaced from one another and/or in a view of the assembly side 4 are substantially located on remote plate sides of the support part 19 or prior to fixing to the base body 3 in cross-section project freely in opposite directions to one another. At least one connecting part 18 can also project freely over the corresponding end of the support part 19 in the longitudinal direction thereof. In addition, the support part 19 or 21 with its corresponding edge face can engage on the assembly side 4 in the vicinity of separate partial faces or in full-surface manner without any direct fixing, can be fixed by means of corresponding strip-like adhesive connections 10 and/or can have a gap spacing from the assembly side 4, which is at the most of the same order of magnitude as the material thickness of the associated connecting part 17 or 18 of the base body 3. In the case of adhesive fixing of the edge face, the adhesive connection can pass through uninterrupted between the two connecting parts 17, 18.

The substantially planar front face of one or all the connecting parts 17, 18 is substantially parallel to the assembly side and has from the latter a spacing which is approximately the same as the material thickness of said connecting part. The front edge face of one or all the support parts 19, 20 can also be substantially parallel to the assembly side 4. At least one support part 19 extends over more than half of the extension of the base body 3 parallel thereto and spaced, adjacent and approximately parallel or equally large support parts 19 in a view of the assembly side 4 can so overlap with longitudinal portions that they cover more than two thirds of the associated extension of the base body 4 and only adjacent to their remote ends are rib-free marginal areas of the base body 3 formed, which are reinforced with connecting parts 18.

As a result of the described construction said possible gaps in the occupancy with adhesive connections are bridged by the aforementioned ribs, so that all areas of the base body 3 are effectively and in gap-free manner reinforced either by connecting parts 17, 18 or by rib or support parts 19, 21 or by both of these together against breakage.

Adhesive connections or connecting parts 17, 18 extend approximately to at least one or all the edge faces or outer edges 23 to 26 of the base body 3, from which the particular adhesive connection 10 can have a smaller spacing than the end of the support part from the associated outer edge or can have a spacing, which is approximately one to four times the material thickness of the connecting part 17. However, all the support parts 19, in a view of the assembly side, have a spacing within the outer boundaries of the base body 3, although it would be conceivable to bridge two adjacent base bodies by at least one connecting part and/or support part, consequently join them together in positionally rigid manner and optionally through the gap between the base bodies to create connecting and assembly possibilities for components from the back 22 of the base body 3, which are to be connected to support bodies or operational parts located on the assembly side 4. However, this assembly or connection possibility can also be achieved in that at least one or all the support bodies 5 to 9 project over at least one or more outer edges 23, 25, 26 and appropriately one outer edge 24 is free from such projecting parts. The strength of the base 1 or the connections to the support bodies is also improved in that the connecting parts 17, 18 and/or the support parts 19, 21 are made from a material which is tougher, more bending elastic and in the sense of a bending loading of the base body 3 much more breakage-resistant, namely of denser joint structure. In order to increase the said strength characteristics, it can also be appropriate if at least one edge face of the base body 3 and/or its back 22 is incorporated into at least one of the connections or joints. For example, a support body 5 or 7 can have at least one orienting member 27 for an arrangement positioned in substantially clearance-free manner relative to the plate plane and/or at least one edge face of the base body 3, so that also the correct assembly arrangement of the particular support body is facilitated, without the aid of separate orienting or aligning devices.

The orienting member 27 of the support body 7 according to FIG. 2 is shaped from an associated connecting part 18 projecting over an outer edge 26 and has two legs 28, 29 at an angle to one another, whereof one leg 28 engages on the edge face 26 and the other leg 29 on the back 22, so that with the connecting parts 18 is formed a U-profile, which engages round the base body 3 on the edge associated with the outer edge 26. If at least one of these legs, e.g. the leg 28, engages in an opening 31 of the base body 3, then there is also an interlocking positioning parallel to the longitudinal direction of the outer edge 26 and consequently in the direction of all three axes in space at right angles to one another.

The said connection is also suitable for fixing components or operational parts, which in a view onto and/or parallel to the assembly side 4 project over the base body 3 and are arranged in parallel displaced manner with respect to its assembly side 4 and/or back 22. For example, at least one plate-like support flange 20 can be constructed in one piece with connecting parts, orienting members 27 or a support part 21, which is rearwardly displaced adjacent to an outer edge 23 of the base body 3 and with respect to its back 22 and ensures that the complete operational unit 2 is fixed in mechanically supported manner on a corresponding mounting support.

The support 21 of this or some other support body can also be used for receiving or connecting an operational part, which in a view on the assembly side 4 is also substantially outside the base body 3 and can e.g. be a sensor tube of a hydraulic temperature sensor, a rod sensor, a control shaft, etc. Furthermore, portions of the support bodies 6, 7, 8, 9 projecting over remote outer edges 25, 26 are constructed as electrical connecting members 32, namely flat plug tongues, which are connected directly and substantially in equiplanar manner to an associated connecting part 18 and/or can be displaced forwards and/or backwards in transverse manner with respect to the assembly side 4 or the back 22. If the connecting member 32 forms with the associated connecting part 18 a planar, strip-like plate, then the connecting members 32 with their backs are substantially in the plane of the assembly side 4, which gives a very simple construction and the associated outer edges 25, 26 can serve as end stops for plug sockets to be engaged.

In the represented embodiment the base 1 is constructed for a thermal cutout signal switch, such as is e.g. disclosed by DE-OS 39 13 288 and DE-OS 39 13 289, to which reference should be made and whilst incorporating the associated features and effects into the present invention. Two cross-sectionally angular support bodies 8, 9 having on the assembly side 4 only two angle legs form with the support part thereof a contact plate 33 for a movable contact which is fixed with respect to the base body 3 and which directly form the contact face, or can have for the same a separate, fixed contact stud. The particular contact plate 33 can have associated with it a contact stop 34 for the associated movable contact and said contact stop 34 is appropriately formed by the end of the elongated, strip-like support part 19 of a further support body 6 or 7, which for this purpose can be provided with a one-piece, burl or knub-like stamping. With its other end slightly displaced by an offset the support part 19 forms a spring bearing 34 for flat, electrically conductive fixing of the associated end of a leaf or contact spring, which carries at the other end the movable contact positioned between the contact plate 3 and the contact stop 34. If it is a bistable snap-action contact, then the support part 19 also has between its two ends an abutment 36, which projects transversely and is constructed in one piece therewith for a terminal edge of an arcuately curved catch spring, which is appropriately shaped in one piece from the contact spring.

The connecting part 17 located on one side of the two strip-like support parts 19 is angled at its end remote from the associated support part 19 to the further support part 21, which carries a freely projecting collar, which is roughly parallel to the assembly side 4 only on its leg inside and which has an internal thread constituting an adjustment bearing 37. The adjustment bearing 37 is substantially aligned with operating bearings 38, which are provided in the form of rectangular openings between the ends and in the vicinity of the overlapping longitudinal portions in the support parts 19. On the other side of the support parts is located the support part 21 angled from the support body 5 and which forms a sensor bearing 39 and for this purpose need only be provided with a passage opening for a push rod of the temperature sensor. This sensor bearing 39 is located between two connecting parts 17, 18 of the associated support body 5 and with gap spacing directly adjacent to a connecting part 17 of the adjacent support part 19 freely projecting against the same and the part 17 engages in the gap between the parts 17, 18 of the support body 5. In the reentrant angular zone between the connecting parts 17, 18 of the support part 19 of the support body 6 engages the connecting part 18 of the support body 9.

For the purpose of fixing the support body, on the assembly side 4 the base body 3 closely limited to the surface size of the associated adhesive connection 10 or assembly surface 11 is provided with a few tenths or a few 1/10 mm thick connecting coating 30 of substantially constant thickness, which can e.g. be pressed on. With an approximately horizontal positioning of the base body 3, the associated support body can be so engaged with its connecting surface or surfaces 12, that they are congruent to the assembly surfaces 11 or the connecting coatings 30. The connecting surface or surfaces 12 of the support body are so arranged with respect to its centre of gravity, that they form stable standing surfaces for the support body in the sense that the latter can be positioned in free-standing manner on said surfaces and cannot tilt, even if no additional support measures are taken. After mounting all the necessary support bodies 5 to 9 in this way and optionally preattaching them by self-adhesion, the thus prepared unit is passed through a heating chamber, e.g. a soldering furnace, in which the initially substantially solid connecting coating 30, including the faces 11 and 12 and their bodies are heated completely to at least the melting point of the connecting coating 30 and consequently the latter is liquefied. It passes through into the surface pores of the faces 11, 12. This requires no separate mechanical compressive loading for pressing the connecting parts 17, 18 against the assembly surfaces 11, because the weight of the support body alone is sufficient. However, it is also conceivable to carry out the production of the connection in the manner of induction welding or using electric welding tongs, with which the particular connecting part 17, 18 is pressed against the base body until the connecting coating 30 solidifies.

In the liquid state the connecting coating 30 is displaced to the outer edges of the connecting part 17, 18 under the normal forces which occur, so that following solidification on the edge faces of the connecting parts 17, 18 or following on to the connecting face 12 it forms a hollow fillet weld 40, which surrounds the connecting parts 17, 18 on at least three outer edges at an angle to one another and in the case of a connecting part 18 projecting over an outer edge 25 or 26 can also cover the associated edge and plate faces of the two bodies. In addition, the connecting coating can also be provided in the vicinity of the connecting member 27 or in the vicinity of the leg 28 and/or 29 and can pass uninterruptedly from the assembly side 4 to the associated edge face 23 or 24 or 26 and/or to the back 22.

However, a support body can also carry a freely projecting component unfixed by a connecting part, an orienting member or an adhesive connection and which as an operational part is movable with respect to the base body and instead of being fixed to the assembly side 4 by the adhesive connection is optionally only fixed to an edge face and/or the back of the base body. For example, the support flange 20 can be elastically movable or deflectable relative to the base body 1, so that vibrations acting on its mounting support are not transferred in undamped manner to the base 1. Since, in view of the given centre of gravity position, the support flange 20 cannot be placed in stable standing manner on the assembly side 4, such components appropriately have the aforementioned positioning or orienting members 27.

As a result of the inventive procedure it is possible to fully automatically produce at least the base 1 and optionally the entire operational unit using corresponding manufacturing and assembly robots, in which all the necessary operations can be performed in programmecontrolled manner and without any manual work. For example, the assembly side 4 of the base body 3 on passing through an applicator can be provided on the intended assembly faces 11 or in whole-surface manner with the electrically conducting or insulating connecting coatings 30. Then using one or more grippers the supports bodies 5 to 9 are successively, in groups or all together placed in the correct position on roughly horizontally positioned assembly side 4 and in this way so preattached that they can no longer be displaced, at least parallel to the assembly side 4 even under strong loads. This is followed by the described production of the final adhesive connection or joint 10.

After cooling, it is then possible to fit the necessary operational parts indicated in dot-dash line manner in FIG. 1, followed by the adjustment of the operational unit and finally the snapping on of a hood-like cover 41 in such a way that with its plate or base body 3 located in its hood opening it bounds a substantially closed casing area, in which are located all the components positioned on the assembly side 4 within the outer boundaries of the base body 3 and over which project to the outside the connecting members 32 or the support flange 20. As the support bodies 5 to 9 are stable to the temperatures necessary for producing the final adhesive joints 10 and are so constructed that subsequently less temperature-resistant components can be fixed, the advantage is obtained that for producing the adhesive connections 10 all the bodies to be interconnected can be heated over their entire extension to the necessary temperature and there is not merely a partial heating, such as with a soldering gun.

The support body 5 can form a preassembled component with the outer tube 43 of a rod-like temperature sensor 42, which projects freely roughly parallel to the assembly side 4 and like the support flange 20 over the outer edge 23 remote from the adjustment bearing 37. The associated end of the outer tube 43 can be rigidly connected e.g. by welding to the operating bearing 38, or can engage in centred manner in a bore of the sensor bearing 39. Within the outer tube 43 is located an inner rod 44, whose outer end is supported on a stop in the vicinity of the free end with respect to the outer tube 43 and whose inner end extending into the vicinity of the assembly side 4 acts as a push rod on e.g. a ceramic material actuating rod 45, which is displaceably guided in the operating bearings 38. The electrically insulating operating rod 45 acts with an operating shoulder on a pressure cam of a contact spring 47 of the snap-action contact located closer to the temperature sensor 42 and whose dimensionally stable basic body is directly formed by the support part 19 of the associated support body 7. The rod 45 traverses the catch spring 47 of the snap-action contact in the vicinity of a corresponding opening, which is located in the longitudinal direction adjacent to the catch spring 48. In FIG. 1 the contact spring of only a single snap switch or support body 7 is shown, whilst the not shown catch springs of the other support body 6 are located on the remote side of the associated support part 19.

The end of the operating rod 45 projecting over this side is axially supported with respect to an adjustment member 46 constructed as a screw and whose support face is optionally resiliently tensioned against the end face of the rod 45, so that the latter is axially clearance-free relative to the inner rod 44. Instead of guiding the adjustment member 46 directly in the inner thread of the adjustment bearing 37, the latter can receive an adjustment support in axially displaceable and spring-loaded manner against the operating rod 45 and on which is adjustably and fixably mounted the adjustment member 46. In place of the operating rod 45, said adjustment support can act for operation on the pressure cam of the snap switch enclosing the support body 6.

Independently of the described constructions, the invention also relates to a switching device, particularly a thermal cutout for radiant heating units or the like, which on exceeding a given limit temperature with a circuit-breaker automatically switches off part or the entire installed capacity of the heating device provided with the switching device and on dropping below a predetermined limit temperature automatically switches it on again. Such switching devices can e.g. be constructed according to DE-OS 35 40 414, 37 05 260 and 39 13 289, to which reference should be made for further features, effects and advantages and which are incorporated by reference into the present invention.

If the circuit breaker is adjusted following the installation of the switching device in the heating unit, then this is relatively complicated, because then the adjustment member is usually very difficultly accessible. Thus, an inventive adjustment method is proposed, according to which the adjustment of one or more of the switches of the switching device takes place in its state separated from the heating unit, e.g. at the time of joining together the components of the switching device. Adjustment appropriately takes place in an automatic assembly and production line as the final production stage. The associated adjustment member can e.g. be constructed in substantially smooth-surface manner on its bearing face according to patent application P40 29 351.3 and/or can be fixed in the adjustment position by welding. Reference should be made to said patent application for further features, effects and advantages and it is incorporated by reference into the present invention.

The adjustment or adjustment member for the signal switch further away from the temperature sensor than the circuit breaker is appropriately carried out or is accessible in the area of the outside of the base remote from the temperature sensor. As a function of the position and construction, this adjustment member can correspond to the adjustment member 46 of FIG. 1. Preferably, instead of being provided with an external thread, the bearing surface of said adjustment member is provided with a thread-free, smooth bearing or outer surface, so that it is adjusted by mere longitudinal displacement along the smooth-surface, substantially radial clearance-free, closely adapted bearing opening of the adjustment bearing 37. The adjustment member can be constructed as a round wire portion or a rod portion produced by cutting to length from a profile rod and without any reworking being necessary. Following the adjustment of the signal contact the adjustment member 46 is non-detachably fixed by welding, particularly laser welding with respect to the adjustment bearing 37 or the support part 21. This completely excludes a subsequent accidental change to the set adjustment.

For the destruction and screw-free, removable securing of the cover 41 with respect to the base 1, in the vicinity of its hood opening said cover is provided on the inside of its casing wall with locking members 40, with which are associated countermembers 50 on the base 1 for resilient self-locking. If these countermembers 50 are e.g. in the form of openings on one or more support bodies, e.g. on the legs 48 and/or are only formed through the back 22 of the base body 3, then there is no need to provide the latter with special deformations for the formation of the countermembers.

I claim:

1. A base for an electromechanical operational unit, said electromechanical operational unit including actuating means and at least one operational component to be supported by said base against mechanical actuating stresses exerted by operation of said operational unit, said base comprising:

a base body having sides, said sides including at least one assembly side, said assembly side providing an assembly surface at least partly made from insulating material; and at least one support body separate from said base body and provided for supporting the operational component with respect to said assembly surface against said actuating stresses, said support body having at least one connecting face attached to said assembly surface, said base body and said support body being provided for receiving said actuating stresses, wherein said support body is at least partly rigidly fixed with at least one adhesive connection to said base body, thereby providing means for transferring said actuating stresses from said support body to said base body via said adhesive connection, said connecting face providing an electrically conducting face.

2. The base according to claim 1, wherein said at least one support body is at least partially fixed to said at least one base body substantially exclusively via at least one melted connection.

3. The base according to claim 1, wherein at least in the vicinity of of said assembly surface, said base body is substantially free from at least one of steps, depressions and openings; in said vicinity, said base body having a substantially continuously even surface; on said assembly surface, said base body providing at least one plate surface bounded by peripheral edges, said plate surface being substantially planar throughout within said peripheral edges.

4. The base according to claim 1, wherein said assembly surface is made from at least one of:

a heat-resistant material, a substantially mineral material and a ceramic material.

5. The base according to claim 1, wherein said base body has a thickness extension and at least one surface extension, said base body being made substantially in one piece over said thickness extension, said base body being at least partially free of at least one of:

perforations and marginal cutouts.

6. The base according to claim 1, wherein said connecting face of said support body is oriented substantially parallel to said assembly surface.

7. The base according to claim 1, wherein said support body has at least one exposed connecting member providing at least one edge face, said connecting face being oriented transverse to said edge face, said edge face having a square measure smaller than said connecting face.

8. The base according to claim 1, wherein at least one connecting part is provided, said connecting part providing peripheral edges and said connecting face, said connecting face extending substantially uninterruptedly up to said peripheral edges of said connecting part said connecting part, having a substantially plate configuration.

9. The base according to claim 1, wherein said support body has at least one support part, said connecting face being oriented substantially transverse to said support part.

10. The base according to claim 1, wherein said support body has at least one support part, said support part providing at least one angle profile with said support body, said support part being provided for receiving at least one of:

a movable contact,
a fixed contact,
a sensor,
an adjustment member,
an actuating member,
a working spring and
a plug.

11. The base according to claim 1, wherein said support body provides at least one support flange for substantially entirely mountingly supporting said base.

12. The base according to claim 1, wherein said support body has at least two connecting faces spaced with respect to each other, said support body being fixed to said base body with said connecting face.

13. The base according to claim 1, further comprising a second connecting face, said connecting face and said second connecting face being interconnected substantially exclusively by at least one edge face.

14. The base according to claim 1, further comprising at least one support part, said support part having at least one of:

a main areal and
a main longitudinal extension,
said connecting face and a second connecting face being located at least one of:
substantially on opposite sides of said areal extension of said support part and
mutually displaced substantially parallel to said longitudinal extension of said support part.

15. The base according to claim 1, wherein at least one connecting member is provided by said support body for connection at least one external supply line, said connecting member having at least one shaft section, said shaft section providing said connecting face.

16. The base according to claim 1, wherein said support body has at least one standing surface for self-balanced free standing of said support body on said assembly side of said base body.

17. The base according to claim 1, wherein said support body has at least one standing surface, said standing surface being oriented substantially parallel to said connecting face and at least partly provided by said connecting face.

18. The base according to claim 1, wherein said support body provides at least one first support body and at least one second support body, connecting parts being provided, said second support body having at least two connecting space, in a view on said assembly side, said connecting face of said first support body at least partly engaging between said at least two connecting face of said second support body, said at least two connecting faces being mutually opposed and providing an angular boundary, said connecting face of said first support body being provided by at least one of said connecting parts, said connecting part freely projecting with respect to a second one of said connecting parts of said second support body, said first connecting part and said second connecting part being juxtaposed.

19. The base according to claim 1, wherein said support body has at least two remote ends, at least one support part being provided, said support part having at least one external surface, said connecting face being at least one of:

at least partly connected to at least one of said remote ends and
at least partly located at distances between said remote ends
said external surface being at least partially transient directly to said connecting face via at least one angled section, said angled section substantially connecting to said assembly surface.

20. The base according to claim 1, wherein said connecting face is defining a connecting area extension, at least one support part defining a support area extension, said support area extension being substantially of same order of magnitude as said connecting area extension and mountingly associated with said support part, said support part being at least partially oriented transverse to said connecting face.

21. The base according to claim 1, wherein said base body has peripheral edges, said connecting face substantially connecting to said peripheral edges of said base body, said base body being substantially rectangular, at least one of said peripheral edges providing a substantially uninterrupted continuous edge.

22. The base according to claim 1, wherein on said assembly side said connecting face is provided, at least one connecting part being provided, said connecting face being located substantially in a single plane, said connecting part at least partially providing substantially constantly thick plate members defining a thickness extension, said connecting part projecting substantially only by said thickness extension over said assembly side, said support body being provided by a bendingly stamped member.

23. The base according to claim 1, wherein said support body has at least one oriented member for positionally interorienting said support body and said base body with respect to at least one of three spacial axes in an assembly state, said base body having at least one counter member for interlockingly receiving said orienting member of said support body.

24. The base according to claim 23, wherein said base body has peripheral edges, said counter member being located in the vicinity of said peripheral edges, said orienting member overengaging at least one of said peripheral edges and a side of said base body remote from said assembly side, said orienting member of said support body providing a U-shaped plugging member for receiving a marginal section of said base body, said orienting member being made substantially in one part with said support body.

25. The base according to claim 1, wherein said adhesive connection is provided by at least one of:

an adhesive coating,
a connecting coating,
a metallic coating,
a solder coating,
a ceramic coating,
a coating substantially separate from said assembly surface,
a coating substantially separate from said connecting face of at least one of said support body,
a layer printed onto said base body and
a layer anchored in pores of said assembly surface providing a substantially smoothly compacted face having a higher specific material compression than connecting core sections of substantially same material.

26. The base according to claim 1, wherein the operational unit is at least one of:
at least one temperature switch operable by at least one thermo-mechanical temperature sensor,
at least one detector projecting over said base body substantially parallel to said assembly side,
at least one power contact,
at least one signal contact,
at least one contact operated by a switching mechanism and
at least one operational unit being at least partially covered by a hood-like cover.

27. The base according to claim 1, wherein said base body has peripheral edges, at least one cover being provided for at least partially covering the operational unit, said cover being fixed with respect to said base body in the vicinity of said peripheral edges of at least one of said base body.

28. The base according to claim 1, wherein a connecting member and a flat plug tongue member are provided for connecting the operational unit to at least one external appliance line, said members being located substantially in a plane defined by said base body and a plane connecting to said assembly side, said base body having at least one edge, said support body including a section entirely projecting over said edge and a remainder section substantially in congruence with said assembly side, said projecting section defining a first weight and said remainder section defining a second weight at least as high as said first weight.

29. The base according to claim 1, wherein at least one adjusting device is provided for gauging the operational unit, at least one of said adjusting device being positionally secured by a hardened melted joint, at least one adjustment member being provided for gauging a signal switch spaced from a detector, said adjustment member being a rod member having a smoothly surfaced bearing circumference, said adjustment member being positionally and non-detachably secured with respect to at least one adjustment bearing by at least one of:
a welded joint and
a laser generated joint.

30. The base according to claim 1, wherein said operational unit provides at least one of:
a sensor controlled switching device,
an hydraulically controlled switching device and a manually controlled switching device.

31. The base according to claim 1, wherein said base body and said assembly side each have an overall area extension of less than 1000 $mm^2$.

* * * * *

UNITED STATES PATENT AND TRADEMARK OFFICE

CERTIFICATE OF CORRECTION

PATENT NO. : 5,321,381

DATED : June 14, 1994

INVENTOR(S) : Essig

It is certified that error appears in the above-identified patent and that said Letters Patent is hereby corrected as shown below:

Column 12, line 46, after "vicinity of " delete "of".

Column 14, line 2, replace "space" with --faces--.

line 4, replace "face" with --faces--.

Signed and Sealed this

Sixth Day of December, 1994

Bruce Lehman

*Attest:*

BRUCE LEHMAN

*Attesting Officer*

*Commissioner of Patents and Trademarks*